US010961110B2

(12) United States Patent
Moyne et al.

(10) Patent No.: US 10,961,110 B2
(45) Date of Patent: Mar. 30, 2021

(54) ELECTROMECHANICALLY OPERATED FUEL NOZZLE

(71) Applicant: SHELL OIL COMPANY, Houston, TX (US)

(72) Inventors: William Moyne, Somerville, MA (US); Hector Padilla, Chelsea, MA (US)

(73) Assignee: SHELL OIL COMPANY, Houston, TX (US)

( * ) Notice: Subject to any disclaimer, the term of this patent is extended or adjusted under 35 U.S.C. 154(b) by 62 days.

(21) Appl. No.: 15/749,211

(22) PCT Filed: Aug. 5, 2016

(86) PCT No.: PCT/US2016/045728
§ 371 (c)(1),
(2) Date: Jan. 31, 2018

(87) PCT Pub. No.: WO2017/024210
PCT Pub. Date: Feb. 9, 2017

(65) Prior Publication Data

US 2018/0237288 A1 Aug. 23, 2018

Related U.S. Application Data

(60) Provisional application No. 62/201,297, filed on Aug. 5, 2015.

(51) Int. Cl.
*B67D 7/36* (2010.01)
*B67D 7/52* (2010.01)
(Continued)

(52) U.S. Cl.
CPC ..... *B67D 7/048* (2013.01); *B67D 7/3218* (2013.01); *B67D 7/3272* (2013.01); *B67D 7/36* (2013.01);
(Continued)

(58) Field of Classification Search
CPC ..... B67D 7/36; B67D 7/362; B67D 7/425; B67D 7/52; B67D 7/42
(Continued)

(56) References Cited

U.S. PATENT DOCUMENTS 4,030,523 A * 6/1977 Cram ..... A23G 9/228 137/599.07
4,630,749 A 12/1986 Armstrong et al.
(Continued)

FOREIGN PATENT DOCUMENTS

WO 2015162270 A1 10/2015

OTHER PUBLICATIONS

International Search Report and Written Opinion received for PCT Patent Application No. PCT/US2016/045728, dated Oct. 26, 2016, 7 pages.

*Primary Examiner* — Paul J Gray

(57) ABSTRACT

An electromechanically operated fuel nozzle having continuously adjustable flow rate settings between a closed position and maximum flow. The fuel nozzle includes a fuel dispensing pipe for dispensing fuel; an electromechanical valve device to control a flow of fuel in the fuel dispensing pipe, comprising an inlet pipe and an outlet pipe. The electromechanical valve device comprises at least one continuously variable flow electromechanical valve to control the flow of fuel; an electronic board for operating the at least one continuously variable flow electromechanical valve; and electric accumulator means for electrically powering the at least one variable flow electromechanical valve and the electronic board such that the predetermined portions provide the particular one of the flow rate settings. The electromechanical valve preferably comprises a servomotor controlled ball valve.

19 Claims, 7 Drawing Sheets

(51) Int. Cl.

| | |
|---|---|
| ***B67D 7/04*** | (2010.01) |
| ***B67D 7/42*** | (2010.01) |
| ***B67D 7/54*** | (2010.01) |
| ***B67D 7/32*** | (2010.01) |
| *B67D 7/46* | (2010.01) |

(52) U.S. Cl.
CPC ..... *B67D 7/425* (2013.01); *B67D 7/52* (2013.01); *B67D 7/54* (2013.01); *B67D 7/465* (2013.01)

(58) Field of Classification Search
USPC ..... 137/599.06, 599.07, 599.08, 601.14; 222/71
See application file for complete search history.

(56) References Cited

U.S. PATENT DOCUMENTS

| | | | | |
|---|---|---|---|---|
| 5,184,309 | A | 2/1993 | Simpson et al. | |
| 5,505,234 | A | 4/1996 | Simpson et al. | |
| 6,223,788 | B1 | 5/2001 | Taylor | |
| 6,374,870 | B1 * | 4/2002 | Muller | B67D 7/067 141/94 |
| 6,561,481 | B1 * | 5/2003 | Filonczuk | F16K 31/043 239/578 |
| 8,302,638 | B2 | 11/2012 | Bentivoglio | |
| 2006/0011652 | A1 * | 1/2006 | King | B67D 7/222 222/71 |
| 2010/0000629 | A1 | 1/2010 | Bentivoglio | |

* cited by examiner

ELECTROMECHANICALLY OPERATED FUEL NOZZLE

CROSS REFERENCE TO RELATED APPLICATIONS

This is a national stage application of International application No. PCT/US2016/045728, filed Aug. 5, 2016, which claims benefit of priority of U.S. provisional application No. 62/201,297, filed Aug. 5, 2015.

FIELD OF THE INVENTION

The present disclosure relates to an electromechanically operated fuel nozzle, in particular for dispensing liquid fuel, such as petrol, diesel, kerosene and the like.

In general, the fuel nozzle according to the present disclosure can be used for dispensing hazardous and/or easily flammable liquids.

More specifically, the fuel nozzle according to the present disclosure is provided with an electromechanically operated valve for opening and closing a fuel-dispensing pipe, or can be fitted with another equivalent electromechanical apparatus for opening and closing a fuel-dispensing pipe.

BACKGROUND

The operation of the dispensing valve of the liquid fuel nozzles currently in common use in distributors is mechanical-manual. For example, they have a lever that can be operated by the user which mechanically opens an on/off valve in the fuel pipe.

A fuel-dispensing nozzle with mechanical operation for the fuel-dispensing valve is illustrated in U.S. Pat. No. 5,505,234 and the nozzle is also provided with an electronic enabling circuit to permit or impede operation of the control for dispensing fuel.

The enabling circuit envisages a pressure switch and a mercury switch capable of inhibiting the operation of the control lever. The mercury switch checks the position of the nozzle and prevents fuel dispensing when the nozzle is arranged at an improper angle for refueling. The pressure switch is sensitive to the pressure in the vehicle tank being filled and interrupts the dispensing of fuel when a predetermined pressure value is reached inside the tank.

A fuel-dispensing nozzle is illustrated in U.S. Pat. No. 5,184,309 with electric operation of a fuel flow control valve. A pulley mechanism is envisaged to operate the flow control valve actuated by a control trigger and an electromagnetic coupling between the control pulley and the valve-opening pulley.

U.S. Pat. No. 5,184,309 also describes how it is possible to use an electric motor which operates the valve-opening rod via a mechanical coupling that transforms the movement from rotary to linear, or an electromagnetic coil which directly operates the valve-opening rod. In this last embodiment, it is also possible to have saw-tooth surfaces on the rod, oriented in such a way as to permit opening of the valve and which keep the valve open when dispensing fuel.

Overall, the construction of the fuel nozzle according to U.S. Pat. No. 5,184,309 is complicated, complex, costly and can be subject to defects and malfunctions.

Improved design has been suggested in U.S. Pat. No. 8,302,638. However, that technology also suffers shortcomings such as flow rate settings being limited to three options: high flow, low flow, and no flow.

Having only off, low, and high flow settings does not give the nozzle user the adjustability that is preferred when refueling different types of vehicles. For example, some vehicles based on their filler neck geometry cannot be refueled at the high flow setting because they over fill quickly. In these cases, the low setting may be too slow and time consuming.

The present invention aims to provide an electronic fuel dispensing nozzle having improved flow control and functionality.

SUMMARY

The present disclosure provides an electromechanically operated fuel nozzle comprising: a fuel dispensing pipe for dispensing fuel; an electromechanical valve device to control a flow of fuel in the fuel dispensing pipe, comprising an inlet pipe and an outlet pipe; the electromechanical valve device comprising at least one continuously variable flow electromechanical valve to control the flow of fuel; an electronic board for operating the at least one continuously variable flow electromechanical valve; and an electric power connection for electrically powering the at least one variable flow electromechanical valve and the electronic board.

In an embodiment, the at least one continuously variable flow electromechanical valve provides a substantially continuously variable level of flow from minimum (zero) to 100%.

In another embodiment, the nozzle comprises a diaphragm that in the rest position separates and closes the inlet pipe from the outlet pipe and having the function of an on/off valve in the fuel dispending pipe, the at least one continuously variable flow electromechanical valve being adapted to substantially continuously adjust the position of the diaphragm between a closed position and a fully open position.

A piloting chamber may be arranged between the diaphragm and a cover, the piloting chamber being in communication with the inlet pipe through a calibrated hole in the diaphragm, and being in communication with the at least one continuously variable flow electromechanical valve through a communication channel.

In an embodiment, the nozzle may comprise an electronic accumulator connected to the electric power connection. The electric accumulator may comprise a battery or super capacitor.

In another embodiment, the nozzle may comprise a continuous electric power supply connected to the electric power connection using an inductive coupler and wire. This embodiment allows the nozzle to be electrically powered from the mains. Co-pending patent application PCT/EP2015/058967 provides a practical embodiment, which is incorporated by reference in this respect. Optionally, the continuous electric power supply may be combined with an electronic accumulator. The latter provides some form of local energy storage with the wired part to clean the electrical power, for instance to prevent voltage spikes, or to provide emergency backup power.

The continuously variable flow provided by the at least one continuously variable flow electromechanical valve in the piloting chamber may cause a variable flow from the inlet pipe to the outlet pipe through the diaphragm.

The improvements disclosed herein may improve the construction of electromechanically operated liquid fuel-dispensing nozzles of known types.

The improvements may provide an electromechanically operated liquid fuel nozzle that is safe and reliable.

The improvements disclosed herein may provide an electromechanically operated liquid fuel nozzle that is handy and easy to operate.

The improvements may provide an electromechanically operated liquid fuel nozzle that is sealed and explosion-proof.

The improvements disclosed herein may provide an electromechanically operated liquid fuel nozzle that is simple and economical to manufacture.

As a result of the improvements, the fuel nozzle may be compact and light and it may be possible to obtain a substantially continuously variable level of flow rate from minimum (zero) to 100% using at least one continuously variable flow electromechanical valves.

Furthermore, this disclosure may provide improved flow control as compared to other electromechanically operated fuel nozzles by utilizing less energy than certain known systems.

Furthermore, this disclosure may provide higher resolution flow control as compared to other electromechanically operated fuel nozzles.

BRIEF DESCRIPTION OF THE DRAWINGS

Further objects and advantages of the present disclosure may become evident in light of the following detailed description, provided with reference to the attached drawings, in which.

DETAILED DESCRIPTION

Figure 1:
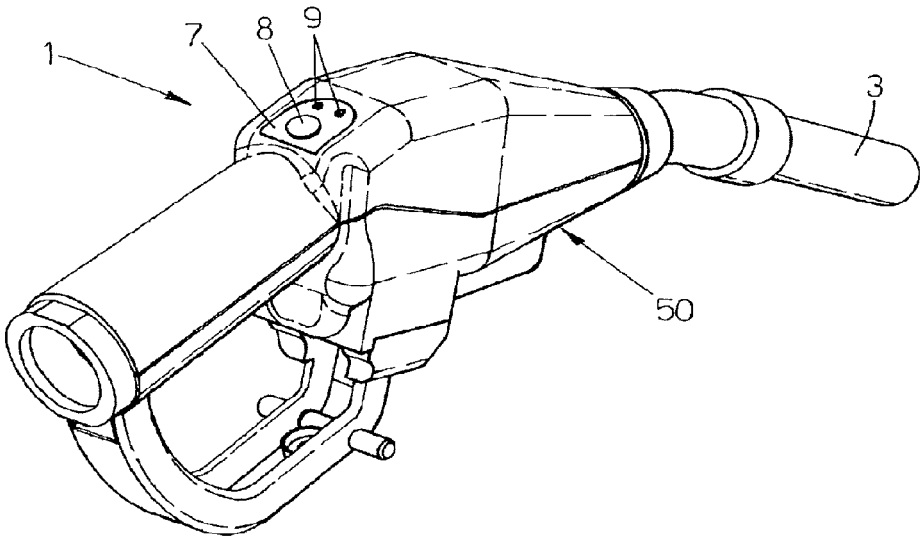
FIG. 1 (Prior Art)
FIG. 1 is a perspective view of a prior art fuel nozzle.

With reference to the drawings, FIG. 1 indicates the whole of a liquid fuel nozzle. The fuel nozzle 1 may include an on/off solenoid valve 2 that can open and close, and a pipe 3 for dispensing liquid fuel, for example petrol, diesel or kerosene.

Figure 2:
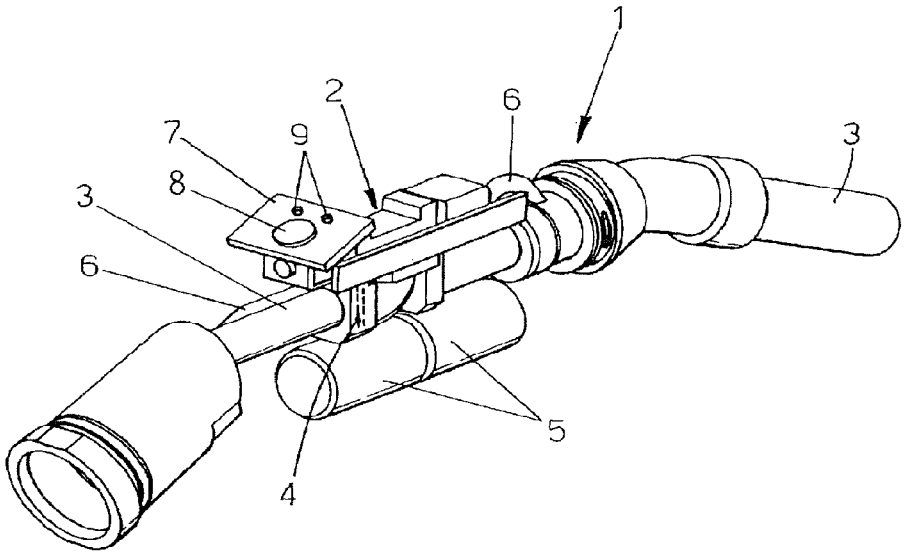
FIG. 2 (Prior Art)
FIG. 2 is a perspective view of internal details of the fuel nozzle in FIG. 1.

Referring to FIG. 2, the solenoid valve 2 may also include a secondary channel 4 for dispensing a small quantity of fuel, for topping up, when it is necessary to dispense an exactly predefined quantity of fuel.

The solenoid valve 2 is preferably made of a flash-proof material, for example flash-proof brass, and with sealing gaskets that are resistant to fuels and/or hydrocarbons. The gaskets can be made of fluoroelastomer, for example Viton (a registered trademark of DuPont Dow).

One or more electric accumulators 5 may be provided for the electrical supply of the solenoid valve 2. The electric accumulators 5 may be, for example, rechargeable batteries or super-capacitors.

In another embodiment, the nozzle may comprise a continuous electric power supply connected to an electric power connection of the nozzle using an inductive coupler and wire. This embodiment allows the nozzle to be electrically powered from the mains. Co-pending patent application PCT/EP2015/058967 provides a practical embodiment, which is incorporated by reference in this respect. Optionally, the continuous electric power supply may be combined with an electronic accumulator. The latter provides some form of local energy storage with the wired part to clean the electrical power, for instance to prevent voltage spikes, or to provide emergency backup power.

The fuel nozzle 1 may also include a vapor-extraction pipe 6 and/or an electronic board 7 for controlling and regulating the solenoid valve 2 in response to inputs, such as selection of a particular one of a number of flow rate settings.

The vapor-extraction pipe 6 may, in turn, be controlled by a solenoid valve 32 (FIG. 3), connected to the electronic board 7 to define a certain relationship between the dispensing of the fuel and the extraction of the vapors. This relationship may be modifiable by appropriate programming of the electronic board 7.

The electronic board 7 may also include an operating button 8 that can be made of metal, for example steel, to prevent damage caused by vandalism, and LEDs 9 to indicate the operating mode of the fuel nozzle 1.

For example, the LEDs 9 may be one, or two LEDs with red and/or green lights, or other similar colors, to signal the operating conditions or blockage of the fuel nozzle 1 to the user.

The exterior of the fuel nozzle 1 may have a shell or casing 50 made of a plastic shockproof material that completely encloses and protects all the internal components. The casing 50 may have an ergonomic shape that is easy to handle even by unskilled persons. The casing 50 may also be liquid-tight to prevent any bleeding of fuel.

Figure 4:
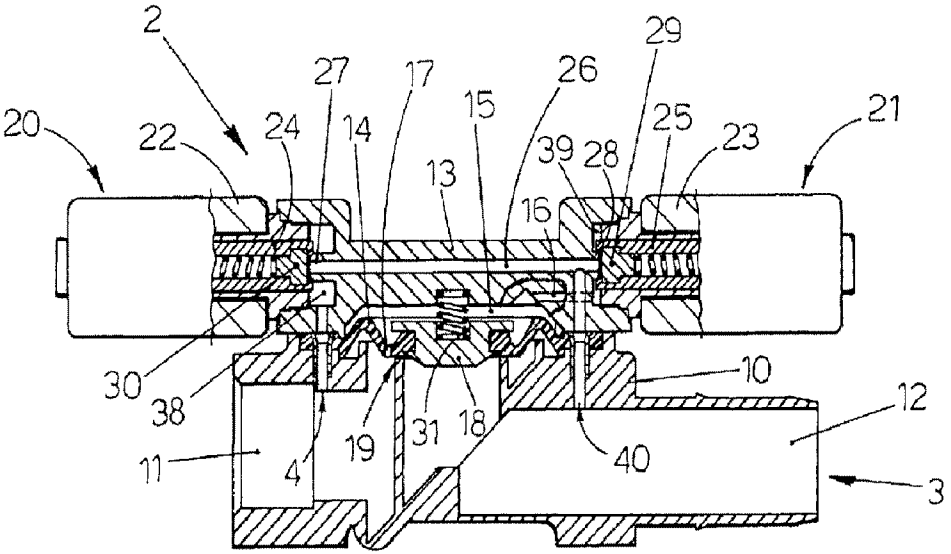
FIG. 4 (Prior Art)
FIG. 4 is a sectional view that illustrates some details of the fuel nozzle in FIGS. 2 and 3, with the nozzle in rest conditions.
Figure 5:
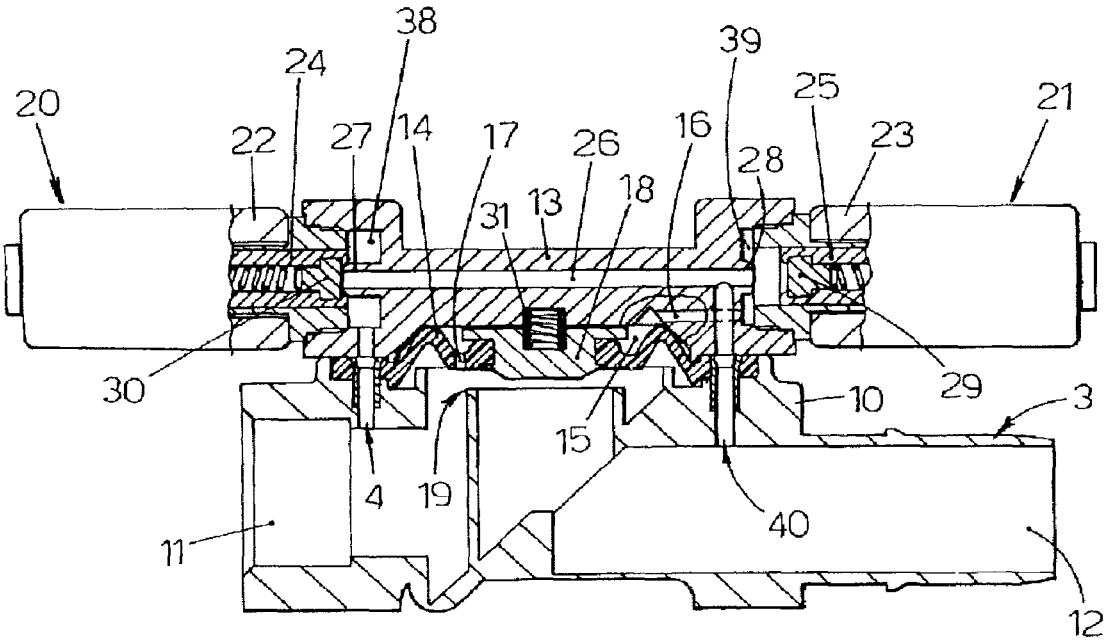
FIG. 5 (Prior Art)
FIG. 5 is a sectional view that illustrates some details of the fuel nozzle in FIGS. 2 and 3, with the nozzle in fuel-dispensing conditions.
Figure 6:
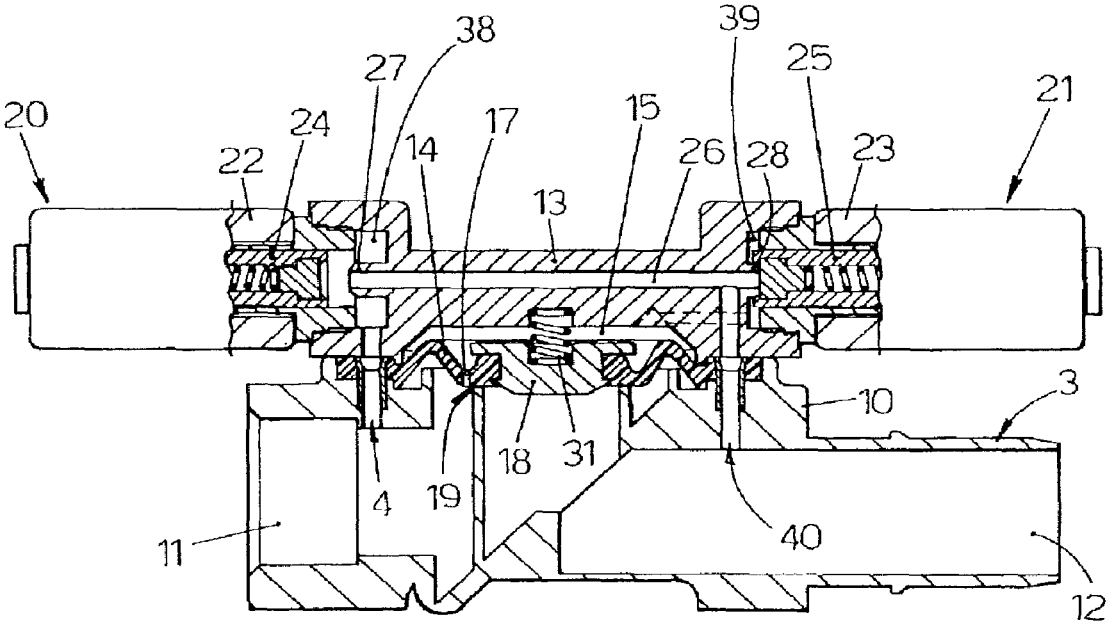
FIG. 6 (Prior Art)
FIG. 6 is a sectional view that illustrates some details of the fuel nozzle in FIGS. 2 and 3, with the nozzle in partial fuel-dispensing conditions.

FIGS. 4-6 illustrate some sections of an exemplary solenoid valve 2, in different operating conditions. In FIG. 4, the solenoid valve 2 is closed and prevents the passage of fuel. In FIG. 5, the solenoid valve 2 is open and is in normal fuel-dispensing conditions permitting maximum flow. In FIG. 6 the solenoid valve 2 is in fuel-dispensing conditions for topping up, permitting an intermediate flow.

The solenoid valve 2 may include a body 10 having an inlet pipe 11 and an outlet pipe 12 connected to the fuel-dispensing pipe 3.

A cover 13 may fixed on the body 10, for example, by some screws which are not shown. The cover 13 may be separated from the body 10 by a diaphragm 14. In the rest position, the diaphragm 14 may separate and close the inlet pipe 11 from the outlet pipe 12 and have the function of an on/off valve.

A piloting chamber 15 may lie between the diaphragm 14 and the cover 13. The piloting chamber 15 may be in communication with the inlet pipe 11 through a calibrated hole 17 found in the diaphragm 14. The diaphragm 14 may also include a rigid part 18, envisaged to encourage tightness of the diaphragm 14 on a seat 19 realized in the body 10. When the diaphragm 14 rests on the seat 19 it may hermetically close the outlet pipe 12 and the rigid part 18 may help to support the pressure of the fuel resulting in the piloting chamber 15.

Furthermore, a spring 31 may act on the rigid part 18 of the diaphragm 14 to assist the closed position of the diaphragm 14 on the seat 19. Also found on the cover 13 may be a first and a second electromagnetic operating device 20 and 21 which, for example, can be realized via electric coils 22, 23 and anchors 24, 25, made of a ferromagnetic material.

The electromagnetic operating devices 20 and 21 may be inserted tight in respective chambers 38, 39 obtained in the cover 13. For example, the electromagnetic operating devices 20 and 21 can be screwed tight into suitable threaded seats obtained in the cover 13. The chamber 38 may be in communication with the inlet pipe 11 via the secondary channel 4.

Via the anchors 24, 25, the electromagnetic operating devices 20 and 21 may make it possible to open and close two ends 27, 28 of a connection pipe 26 that puts the chambers 38 and 39 into communication with each other and which can also be found in the cover 13. In particular, the first end 27 of the connection pipe 26 may be found in the chamber 38 and the second end 28 may be found in the chamber 39.

The pipe 26 may also be connected to the outlet pipe 12 via a discharge channel 40. In order to reduce dimensions, the electromagnetic coils 22, 23 and the anchors 24, 25 may have their own respective axis of rotation and movement parallel to the inlet and outlet pipes 11, 12. In accordance with the illustrations, in particular in FIGS. 3-6, the electromagnetic coils 22, 23 and the anchors 24, 25 may be horizontal as are the inlet and outlet pipes 11, 12, and in general like the pipe 3 for dispensing the fuel. A reduction in the height of the solenoid valve 2, which can easily be inserted in the casing 50, may be obtained with this configuration.

The piloting chamber 15 may be connected to the chamber 39 in which the end 28 can be found via a further communication channel 16, while the end 28 of this chamber 39 can be closed by the anchor 25 of the electromagnetic operating device 21.

In order to improve tightness when they are closed, the ends 27, 28 may be prominent compared with the inner surface of the chambers 38 and 39 and the operating devices 20, 21 may have sealing surfaces 29, 30, for example in fuel-proof rubber.

When the solenoid valve 2 is closed (FIG. 4), both electromagnetic operating devices 20 and 21 may be deactivated, the fluid, or the fuel, under pressure in the inlet pipe 11 may pass into the piloting chamber 15 through the calibrated hole 17 in the diaphragm 14.

The force developed by the pressure of the fuel in the piloting chamber 15 and the force of any spring 31, acting on the top part of the diaphragm 14, may be greater than the force developed by the pressure of the fluid acting on the bottom part of the diaphragm 14, as it acts on a bottom annular area that is smaller than the total top area of the diaphragm 14.

Therefore, the diaphragm 14 may position itself to rest on the seat 19 and, by closing it, divide the inlet pipe 11 from the outlet pipe 12.

When the solenoid valve 2 is required to dispense the maximum fuel flow for refueling, the electromagnetic operating device 21 may be activated via the operating button 8 on the electronic board 7.

The second electromagnetic operating device 21 may move the anchor 25 and put the piloting chamber 15 into communication with the outlet pipe 12 through the connection pipe 26 and the discharge channel 40, giving rise to a pressure drop in the piloting chamber 15 which in turn may raise the diaphragm 14, putting the inlet pipe 11 into communication with the outlet pipe 12.

Therefore, the second electromagnetic operating device 21 may operate the diaphragm 14 in an indirect and servo-controlled manner, in such a way as to open and close the full fuel dispensing pipe 3.

When it is necessary to top up the fuel, i.e. when it is necessary to dispense a small quantity of fuel, the second electromagnetic operating device 21 may be deactivated, the pressure in the piloting chamber 15 may increase once more and the diaphragm 14 may return to the closed position on the seat 19.

At the same time, the first electromagnetic operating device 20 may be activated and open the end 27 of the connection pipe 26 which, in turn, may put the inlet pipe 11 into communication with the outlet pipe 12 through the secondary channel 4, the connection pipe 26 and the discharge channel 40, thereby permitting the dispensing of a small flow of fuel for the top-up.

Then, the first electromagnetic operating device 20 may open and close, in a direct manner, the secondary channel 4 for topping up the fuel.

The top-up flow may be determined by the passage sections of the abovementioned secondary channel 4, connection pipe 26 and discharge channel 40 which may be appropriately dimensioned in such a way as to obtain the desired flow (e.g., about 3 liters per minute) with the delivery pressures normally used in fuel distributors (e.g., about 1.5 bar).

When dispensing the top-up flow, the pressure in the piloting chamber 15 may remain high, keeping the diaphragm 14 in the closed position on the seat 19. This may be due to the fact that, as the top-up flow is relatively small, the pressure in the inlet pipe 11 may not drop in a significant manner and, as a result, the pressure in the piloting chamber 15 may remain substantially unchanged.

In accordance with an alternative embodiment not illustrated, there is no first electromagnetic operating device 20 and the end 27 of the connection pipe 26 is opened or closed via a direct mechanically operated valve.

It should be noted that the solenoid valve 2 may also be very compact as it includes, already incorporated, the channels for full dispensing with a high fuel flow and for topping up with a low fuel flow. Furthermore, the electromagnetic operating devices 20, 21 take up little space and, in particular, have electromagnetic coils, 22, 23 and anchors 24, 25 with the axis parallel to the inlet and outlet pipes 11, 12.

Figure 3:
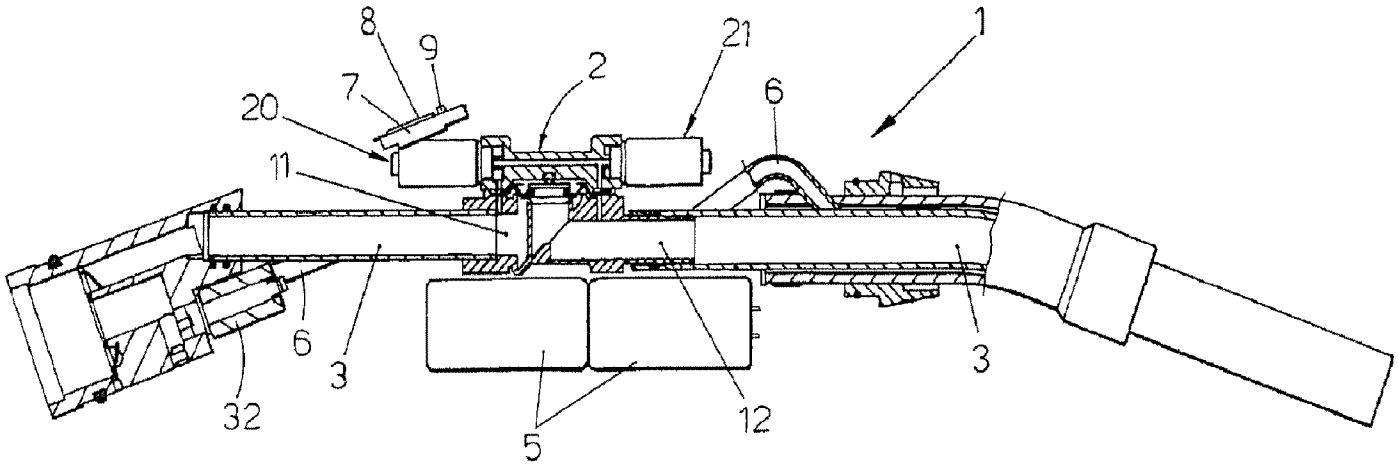
FIG. 3 (Prior Art)
FIG. 3 is a view, partly in section, of some details of the fuel nozzle in FIG. 2.

As is evident from FIGS. 1-3 in particular, the solenoid valve 2 may therefore be just a little higher than the above mentioned inlet and outlet pipes 11, 12 and, therefore, it can be inserted in an optimum manner into the casing 50 of the fuel nozzle 1, contributing to keeping the dimensions small.

The fuel nozzle 1 can be realized in at least two main versions: for refueling cars or for trucks. By way of example it can be indicated that, with a fuel delivery pressure of 1.5 bar, the flow is about 45 liters per minute for the car version of the nozzle, about 80-90 liters per minute for the truck version of the nozzle, and about 3 liters per minute for the top-up flow.

In use, the fuel nozzle 1 may initially be placed in an appropriate nozzle-holder seat on the distributor which may also provide the maintenance charge of the electrical accumulator 5. When refueling is to be carried out, the user may grip the fuel nozzle 1 and extract it. The switching of a special micro-switch on the nozzle-holder may inform the distributor of the need to start the fuel-dispensing pump.

At the same time, the electronic board 7 of the fuel nozzle 1 may be activated and reset the safety sensors with which the nozzle is fitted.

As a consequence, an LED 9 may light up, red for example, indicating that the fuel nozzle 1 is activated, but fuel-dispensing may not be enabled. If the operating button 8 is pressed by mistake, nothing will happen and no fuel will be dispensed.

When the user inserts the fuel nozzle 1 into the tank of the vehicle to fill, the safety sensors may supply the respective enabling signals for dispensing and, as a consequence, the signaling LED 9 may change color, becoming green for example, or a second green LED 9 may light up, and the first LED may go off, indicating that the fuel nozzle 1 is ready for dispensing fuel.

Fuel dispensing can therefore be activated via a firm, but temporary, pressure on the operating button 8, which can subsequently be released.

In another version for self-service distribution systems, fuel dispensing may be activated by continuous pressure on the operating button 8, for safety reasons and according to any safety regulations in force. These and other functions are in any case modifiable and adjustable with the simple new programming of the electronic board 7.

Fuel dispensing may continue automatically until one of the safety sensors trips, for example the overfill sensor if the vehicle tank is completely full, or up to the quantity previously programmed and then fuel dispensing may stop without the need for any further action.

Naturally, fuel dispensing may also stop if the nozzle angle had changed, if the nozzle had fallen for example, or because the dispensing time is too long.

The maximum dispensing time, which can be reset for about two minutes, can also be modified by reprogramming the electronic board 7.

If, following an interruption in dispensing due to the fuel level rising in the vehicle's tank, the fuel level should drop again for any reason—for example because of a reduction in the foam that might have formed during tank refueling—the LED 9 may turn green again, indicating that the nozzle is enabled once again for a top up, with the same procedures described previously.

The operations to carry out for the user are very simple: release the nozzle from the nozzle-holder, insert the nozzle into the tank inlet, press the dispensing button for a moment, or continuously if requested, wait until refueling is complete, and replace the nozzle.

It is therefore evident that the use of the nozzle according to the disclosure is simple and convenient. Compared with nozzles of the traditional type, the bleeding of fuel and the inconvenience of "blocked dispensing"—via the traditional little blocking hook on the control lever—have been solved and eliminated while, at the same time, reducing the complexity of construction and therefore the cost of the nozzle. It may also be possible to easily integrate different safety devices in order to obtain high operating safety while maintaining the nozzle's simplicity of construction.

As a result of the special design of the solenoid valve 2, which includes already integrated in the inside thereof the pipes and channels for full dispensing with a high fuel flow and topping up with a low fuel flow and via the electromagnetic operating devices 20 and 21 arranged with their axis parallel to the inlet and outlet pipes 11, and 12, the fuel nozzle 1 is compact and takes up little space.

The nozzle according to the disclosure is therefore easy to replace and can be integrated in already existing fuel-distribution systems and in fact shares many of the accessories with these systems.

Figure 7:
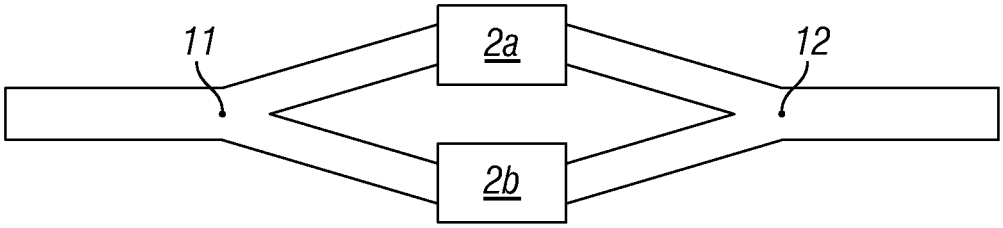
FIG. 7 is a schematic view of a fuel nozzle having two electromechanically operated valves according to the present disclosure.
Figure 8:
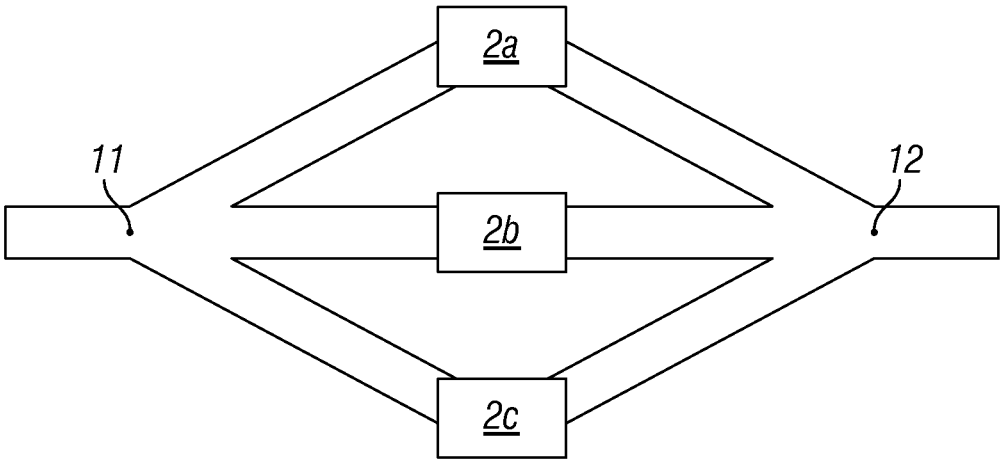
FIG. 8 is a schematic view of a fuel nozzle having three electromechanically operated valves according to the present disclosure.

Referring now to FIGS. 7 and 8, rather than using a single valve 2, two or three or more electromechanically operated valves 2*a*, 2*b*, 2*c* may be used to control the flow of fuel.

In such a configuration, each electromechanically operated valve 2*a*, 2*b*, 2*c* may be configured such that, upon actuation by the electronic board 7, the respective electromechanically operated valve 2*a*, 2*b*, 2*c* permits a predetermined portion of the maximum flow through the fuel-dispensing pipe 3. Together, the predetermined portions of the maximum flow from each valve 2*a*, 2*b*, 2*c* will provide the maximum flow, so long as all valves 2*a*, 2*b*, 2*c* are actuated. However, unlike the solenoid valve 2 described above, the options for flow rate are not limited to minimum flow (e.g., zero), maximum flow (e.g., 100%), and low flow.

For instance, the fuel nozzle 1 utilizing at least two solenoid valves 2*a*, 2*b* can provide at least four flow rate settings: a maximum flow, a minimum flow, and at least two intermediate flow. Such configuration may involve the arrangement of the solenoid valves 2*a*, 2*b*, 2*c* in parallel, with each having access to the inlet pipe 11 and the outlet pipe 12. Each solenoid valve 2*a*, 2*b*, 2*c* may be designed to permit a predetermined portion of the maximum flow to pass therethrough.

Thus, for example, with reference to FIGS. 7 and 8, solenoid valve 2*a* may permit either no flow (closed) or ⅓ of the total maximum flow therethrough, solenoid valve 2*b* may permit either no flow (closed) or ⅔ of the total maximum flow therethrough. In such a configuration, the four flow rate settings would include minimum flow through pipe 3 with both solenoid valves 2*a*, 2*b* closed, ⅓ flow with solenoid valve 2*a* open and solenoid valve 2*b* closed, ⅔ flow with solenoid valve 2*a* closed and solenoid valve 2*b* open, and maximum flow with both solenoid valves 2*a*, 2*b* open. Thus, four flow rate settings can easily be obtained by use of as few as two solenoid valves 2*a*, 2*b*.

In an embodiment, a single multi-stage solenoid valve may accomplish the same purpose. Thus, it is intended that the plural term "valves" should not be limited to separate valves but should instead include equivalents. Notably, the dual flow valve of U.S. Pat. No. 8,302,638 would not be considered such an equivalent because the solenoid valve 2 does not provide a predetermined portion of the maximum flow but instead allows the whole maximum flow to pass therethrough.

Stated otherwise, the predetermined portion of the maximum flow for each of the solenoid valves 2*a*, 2*b* is less than 100% which allows for intermediate flow rates between minimum flow and maximum flow through pipe 3. Generally, it is expected that the predetermined portions of the maximum flow rates for the solenoid valves 2*a*, 2*b* can be combined to arrive at 100% of the flow through pipe 3 (i.e., maximum flow). While the secondary channel 4 allows something less than the maximum flow to pass through pipe 3, the solenoid valve 2 in conjunction with the secondary channel 4 only allow maximum flow or minimum flow through pipe 3, with no additional intermediate options.

The availability of multiple flow rate settings may provide various advantages. For example, some vehicles have a filler neck geometry that would result in overfilling at a high flow setting. In such cases, a low flow setting may be too slow and time consuming The proposed fuel nozzle 1 may provide an electronic fuel dispensing nozzle with similar flow control and functionality of a typical non-electronic nozzle. Also, multiple flow rate settings may give the user an experience similar to that of a typical non-electronic nozzle, allowing users to transition over to the proposed technology seamlessly and without a learning curve.

With reference to FIG. 8, three solenoid valves 2*a*, 2*b*, 2*c* can provide up to eight flow rate settings. For example, if solenoid valve 2*a* were designed with the predetermined flow of 10% of maximum flow, solenoid valve 2*b* were designed with the predetermined flow of 30% of maximum flow, and solenoid valve 2*c* were designed with the predetermined flow of 60% of maximum flow, the following flow rates would all be possible by selectively actuating the appropriate solenoid valves 2*a*, 2*b*, 2*c*: 0%, 10%, 30%, 40%, 60%, 70%, 90% and 100%. The exemplary numbers provided are not intended to be limiting in any way but are provided to illustrate how the use of three valves can provide eight flow rate settings. Likewise, each additional valve would double the available flow rate settings.

Regardless of the number of solenoid valves 2*a*, 2*b*, 2*c* used, the electronic board 7 may be configured to selectively actuate the appropriate solenoid valves so as to provide the appropriate flow rate setting. Such appropriate flow rate setting may be selected and provided as an input to the electronic board 7 at the pump (e.g. selected by the user from the available options). Such selection may involve only squeezing the trigger of a handle an appropriate amount. For example, no change in the position of the trigger may equate with minimum flow rate, with slightly more movement of the trigger being associated with a first intermediate flow rate and even more movement of the trigger being associated with a second, larger intermediate flow rate. Maximum flow may be selected by moving the trigger to an extreme position opposite the minimum flow rate position. Depending on the number of solenoid valves, it is possible that the user would perceive infinite choices, even though, in fact, the number of flow rate settings would technically still be finite.

In an embodiment, the electromechanically operated fuel nozzle according to the disclosure may comprise any combination of at least two electromechanically operated valves arranged in parallel, as shown in FIGS. 7 and 8. Herein, one or more of the valves 2*a*, 2*b*, 2*c* may be replaced with any suitable type of electromechanical valve, such as a solenoid valve, a servo controlled ball valve, or an electromechanical needle valve, to provide the same function.

For instance, a servomotor actuated ball valve 60 (FIG. 9) may be substituted for one or more of the above-described electromechanically operated valves 2, 2*a*, 2*b*, 2*c*. Such substitution may allow for reduced energy to actuate the valve 60 as compared to the solenoid valve 2 because opening and closing of the valve 60 would not require overcoming resistance created by the pressure differential between inlet pipe 11 and outlet pipe 12. Lower energy requirements for actuation may allow for reduced power needs in the nozzle, which may decrease size and/or weight as well as provide for enhanced safety. Multiple ball valves could be used in a setup of parallel electromechanically operated valves 2*a*, 2*b*, 2*c*, etc. as shown in FIGS. 7 and 8 and as described above.

Figure 9:
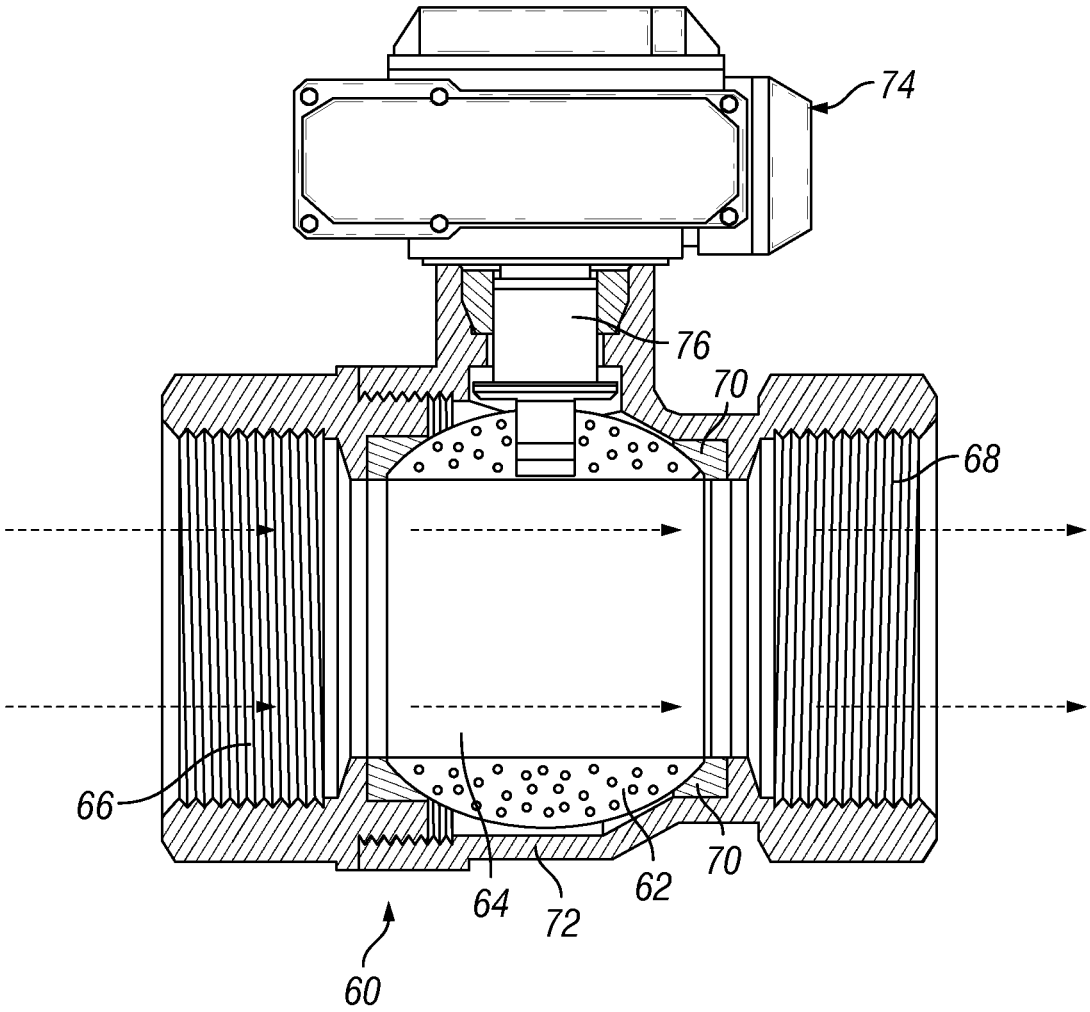
FIG. 9 shows a sectional view of an exemplary embodiment of an electromechanical ball valve.

FIG. 9 shows an example of a ball valve 60. The ball valve is, for instance, a form of quarter-turn valve which uses a hollow, perforated and pivoting ball 62 (called a "floating ball") to control flow through it. It is open when an opening 64 through the ball is in line with valve inlet 66 and valve outlet 68, forming the flow line, and closed when the opening 64 is pivoted 90-degrees with respect to the flow line. The ball 62 may be suspended in bearings 70 arranged in valve housing 72. Mechanical ball valves are typically operated by a valve handle. According to the invention, an electromechanically operated ball valve may be operated by a motor 74, such as a servomotor. Herein, the servomotor is connected to the ball 62 via a stem 76, to control the position of the opening 64 with respect to valve inlet 72 and valve outlet 74. The ball can be turned from a closed position (opening 64 is perpendicular to the flow line) to a fully open position (opening is parallel to the flow line). The ball valve in addition allows intermediate flow positions, by positioning the opening anywhere between the closed and the fully open position. In one of the intermediate flow positions, the midline of the opening 64 is at an angle $\alpha$ with respect to the flow line, wherein $\alpha$ is between 0 degrees and 90 degrees.

In another embodiment, the ball valve 60 of FIG. 9 is arranged directly in the flow line, between the inlet pipe 11 and the outlet pipe 12. Herein, the motor 74 controls the fuel flow between the closed position and the fully open position by correspondingly rotating the ball and the opening therein with respect to flow line. The user activates the button 8, or a similar trigger mechanism. For instance, the button may have various settings, or the button may be pushed various times to arrive at a certain setting of the fuel flow. The motor 74 subsequently rotated the ball 64 to provide the selected flow setting.

In yet another embodiment, a variable pilot valve 80 may be used to actuate or control the diaphragm 14. Variations of the variable pilot valve 80 may include, but are not limited to, a servo valve, a ball valve, a gate valve, or a needle valve. The variable pilot valve may control how much the main valve or diaphragm 14 opens, which may be beneficial because it may allow for variable flow with less power than other designs such as an array of solenoid valves or a servo ball valve placed directly in the flow line.

Figure 10:
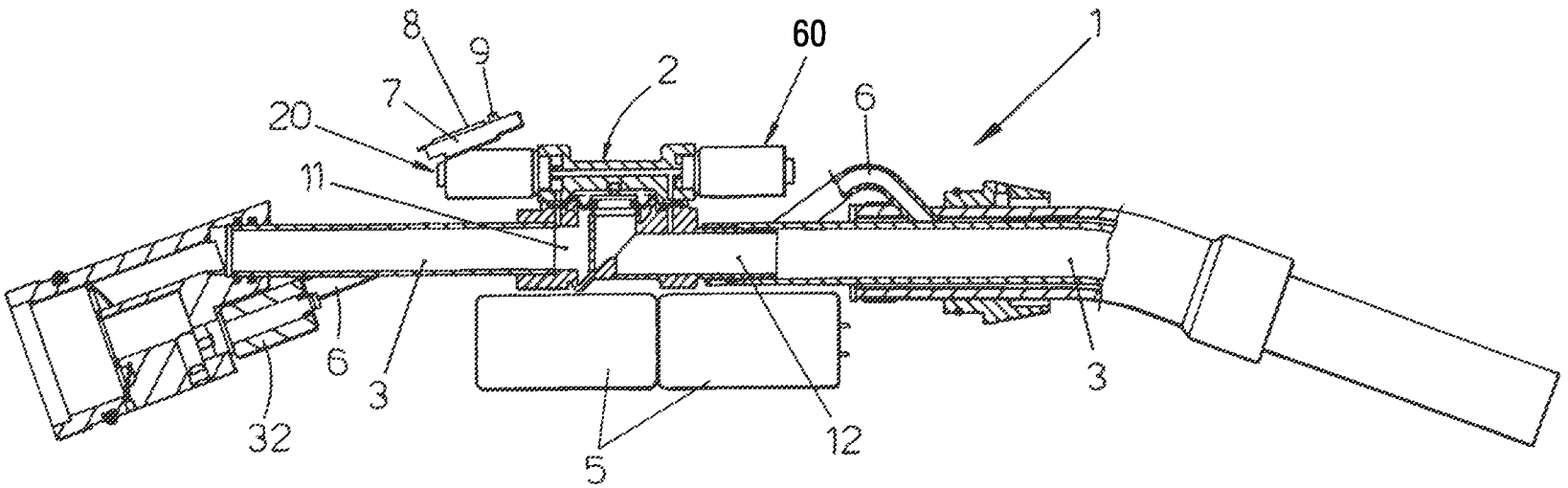
FIG. 10 is a sectional view of an embodiment of a fuel nozzle according to the present disclosure.

FIG. 10 shows an embodiment, wherein the second electromagnetic operating device 21 is replaced with the variable pilot valve, for instance the ball valve 60. The ball valve enables a variable opening, thus enabling variable control of the outlet of the communication channel 16. Variable control herein indicates the ability to select multiple intermediate flow rate settings, between the closed position and the fully open position. The valve 60 controls the outlet of the pilot chamber 15. In combination with the spring 31 and the size of the calibrated hole 17, the valve 60 enables multiple intermediate flow rate settings. This embodiment may obviate the first electromagnetic operating device 20 and the corresponding channel 26 and the secondary channel 4 for top-up low flow rate. This embodiment also may provide a smaller, efficient valve.

Figure 11:
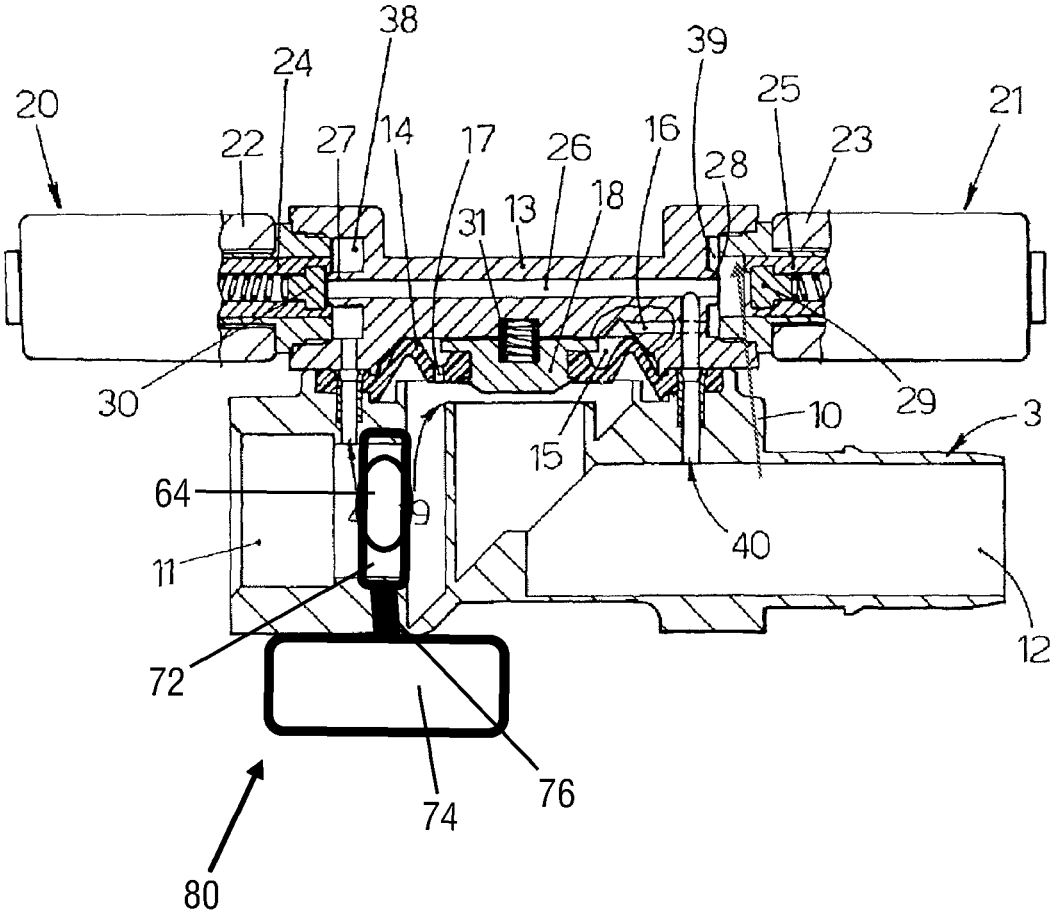
FIG. 11 is a sectional view of details of another embodiment of a fuel nozzle according to the present disclosure.

FIG. 11 shows an embodiment, wherein an electromechanical pilot valve 80 having variable flow adjustability is used to control the flow towards the diaphragm 14 of the main valve. In a preferred embodiment, the electromechanical pilot valve 80 is the electromagnetic ball valve 60, such as shown in FIG. 9. The ball valve provides a variable level of flow from minimum (zero) to 100%. The ball valve 60 provides a variable level of flow to the piloting chamber 15 placed between the diaphragm 14 and the cover 13. Thus, the piloting chamber 15 is in communication with the inlet pipe 11 through a calibrated hole 17 found in the diaphragm 14, and through the pilot valve. Controlling the pilot valve 80 enables variable flow therethrough. The variable flow provided by the pilot valve enables to control the flow in the piloting chamber 15, which causes a variable flow through the diaphragm 14. In addition, the spring loaded diaphragm provides a fail-safe mechanism, for instance in case of power loss or low power. Alternatively, the ball valve 60 may have an integrated spring or reserve power that sets the flow to a minimum (off) should the motor 74 lose power.

The pilot valve 80 may comprise any suitable variable flow electromechanical valve, such as an electromechanical ball valve 60 or an electromechanical needle valve.

In an embodiment, the electromechanically operated fuel nozzle 1 comprises another safety valve with a normally closed property, such as a spring-loaded solenoid valve, in series with the pilot valve 80 to provide a safety shut-off should the system lose power. The pilot valve, such as the ball valve 60, may or may not have a normally-closed feature in addition to the safety valve. In the embodiment shown in FIG. 11, the pilot valve 80 is for instance a ball valve 60, whereas the spring loaded electromechanical device 21 in combination with the spring loaded diaphragm 14 functions as safety valve arranged in series with the pilot valve.

In yet another embodiment, the vapor recovery system (line 6) can be controlled with an additional electromechanical vapor control valve, replacing the solenoid valve 32 (FIG. 3). The vapor control valve (not shown) may be a ball valve 60. The ball 64 thereof may be driven by the same motor 74 as the pilot valve 80 (FIG. 11). In an advantageous embodiment, the ball 64 of the pilot valve 80 and the ball of the vapor control valve may be controlled by the same motor 74. The pilot valve 80 and the vapor control valve may comprise ball valves having two balls 64 stacked on top of each other but sharing the same drive shaft 76. Alternatively, the vapor control valve may be a separate ball valve that is electronically controlled, replacing valve 32 (FIG. 3). The vapor control valve could be continuously variable. Optionally, the continuously variable vapor control valve is controlled substantially proportionally with respect to the electromechanical valve 60 or 80.

While the description above distinguishes between the flow provided by the electromechanical valves 2*a*, 2*b*, 2*c* and that through secondary channel 4, any of the various alternatives described above could readily be combined with the use of the secondary channel 4 to allow for topping up or other flow.

The present disclosure implements the use of an array of (two or more) electromechanical valves in parallel to control the flow of fluid in an electronically operated fuel dispensing nozzle.

The electromechanical valves 2*a*, 2*b*, 2*c* may be single stage solenoid valves (limited to on-off), two-stage solenoid valves (having high flow, low flow and off settings, such as described with respect to FIGS. 4 to 6), multi-stage solenoid valves or a combination of the three. These solenoid valves can be direct acting or internally piloted. Also, the valves 2*a*, 2*b*, 2*c* can be different sizes depending on the intended resolution of adjustability. Different sizes herein may include different size of the opening provided by the open position of the diaphragm 14 (FIG. 5), thus providing correspondingly different flow rate.

In an exemplary embodiment, the first valve may, at least, have a closed position and a fully open position, the fully open position providing a first flow. The second valve may, at least, have a closed position and a fully open position, the fully open position providing a second flow, the second flow exceeding the first flow. An optional third valve may, at least, have a closed position and a fully open position, the fully open position providing a third flow, the third flow exceeding the second flow.

An example of a three electromechanical valve array is one where the first valve 2*a* provides, for instance, about 25% of a predetermined flow, a second valve 2*b* provides about 50% of the predetermined flow, the first and second valve combine to provide about 75% of the predetermined flow and, finally a third valve 2*c* provides about 100% of the predetermined flow. Combining the third valve 2*c* with the first valve 2*a* and/or the second valve 2*b* may provide additional flow settings exceeding the predetermined flow with the set steps, for instance, 25% and 50% additional flow respectively. If there is an interruption in power, the use of normally closed solenoid valves will guarantee the nozzle will fail-safe.

The disclosure solves the problem of having only three limited, preset flow settings on an electronic fuel nozzle. The disclosure provides substantially continuous control of the fuel flow between no flow and maximum flow, using a suitable electromechanical valve, similar to that of a conventional fuel nozzle. In addition, the implementation of a combination or array of electromechanical valves gives the electronic fuel nozzle additional flow adjustability.

The invention implements the use of a variable flow electromechanical valve, such as a servomotor actuated ball valve, to control the flow of fluid in an electronic fuel dispensing nozzle. Servomotors are rotary actuators that allow precise control of angular position. This in conjunction with a ball valve gives this flow control method the ability to regulate flow with almost infinite adjustability between off and maximum flow rate. The servomotor can apply torque to turn the ball valve either directly or through a geared or linkage transmission. If there is an interruption in power, a back-up system such as a spring to turn the valve shut, solenoid valve before or after the ball valve to shut off the flow when power is lost, or small accumulator (battery/super capacitor) that would reserve power for the servomotor to close the valve may also be provided.

Naturally, the present disclosure is not limited to the executive embodiments illustrated and described, but includes all the appropriate variants and modifications for achieving the same result and, therefore, falling within the scope of the appended claims.

In the claims, the references provided between parentheses are purely indicative and do not limit the scope of protection of the claims.

That which is claimed is:

1. An electromechanically operated fuel nozzle comprising:

a fuel dispensing pipe for dispensing fuel;

an electromechanical valve device to control a flow of fuel in the fuel dispensing pipe, the electromechanical valve device comprising:

an inlet pipe;

an outlet pipe in fluidic communication with the inlet pipe, the outlet pipe being connected to the fuel dispensing pipe;

at least two continuously variable flow electromechanical valves comprising:

a first valve;

a second valve arranged in parallel with the first valve between the inlet pipe and the outlet pipe, the first valve and the second valve being operable to control the flow of fuel in the fuel dispensing pipe based on at least four flow rate settings;

an electronic board for operating the at least two continuously variable flow electromechanical valves, the electronic control board including:

at least one operating button activated to selectively actuate the at least two continuously variable flow electromechanical valves based on a first flow rate setting comprised in the at least four flow rate settings; and an electric power connection for electrically powering the at least two continuously variable flow electromechanical valves and the electronic board.

2. The electromechanically operated fuel nozzle of claim 1, wherein the first flow rate setting comprised in the at least four flow rate settings includes one of:

a minimum flow setting;

a first intermediate flow setting;

a second intermediate flow setting; and a maximum flow setting.

3. The electromechanically operated fuel nozzle of claim 1, wherein the at least two continuously variable flow electromechanical valves are selected from the group of a solenoid valve, a servo controlled ball valve, and an electromechanical needle valve.

4. The electromechanically operated fuel nozzle of claim 1, further comprising at least one of:

a diaphragm that in a rest position, separates and closes the inlet pipe from the outlet pipe, the diaphragm being operable as an on/off valve in the fuel dispensing pipe, wherein the first valve of the at least two continuously variable flow electromechanical valves is adapted to continuously adjust a position of the diaphragm between a closed position and a fully open position; and a piloting chamber arranged between the diaphragm and a cover, the piloting chamber being in communication with the inlet pipe through a calibrated hole in the diaphragm, and being in communication with the first valve of the at least two continuously variable flow electromechanical valves through a communication channel.

5. The electromechanically operated fuel nozzle of claim 4, wherein a continuously variable flow is provided by the first valve comprised of the at least two continuously variable flow electromechanical valves thereby causing a variable flow from the inlet pipe to the outlet pipe through the diaphragm.

6. The electromechanically operated fuel nozzle of claim 1, wherein the second valve of the at least two continuously variable flow electromechanical valves has an integrated spring or reserve power configured to set a flow of the electromechanical valve device to a minimum (off) should the electromechanical valve device lose power.

7. The electromechanically operated fuel nozzle of claim 1, wherein the second valve of the at least two continuously variable flow electromechanical valves is arranged in the inlet pipe for controlling a fuel flow therein between a closed and a fully open position.

8. The electromechanically operated fuel nozzle of claim 7, further comprising a third valve with a normally closed property is placed in series with at least one valve of the at least two continuously variable flow electromechanical valves to provide a safety shut-off should the electromechanically operated fuel nozzle lose power.

9. The electromechanically operated fuel nozzle of claim 8, wherein the third valve comprises at least one of a spring-loaded diaphragm and a spring loaded solenoid valve.

10. The electromechanically operated fuel nozzle of claim 1, further comprising a top-up channel for dispensing a lower quantity of fuel for topping up.

11. The electromechanically operated fuel nozzle of claim 1, further comprising an electronic accumulator connected to the electric power connection.

12. The electromechanically operated fuel nozzle of claim 11, wherein the electric accumulator comprises a battery or super capacitor.

13. The electromechanically operated fuel nozzle of claim 1, further comprising a continuous electric power supply connected to an electric power connection using an inductive coupler and wire.

14. The electromechanically operated fuel nozzle of claim 1, further comprising a vapor-extraction pipe, the vapor-extraction pipe being controlled by a fourth valve connected to the electronic board.

15. The electromechanically operated fuel nozzle of claim 14, wherein a relationship between dispensing of fuel and extraction of vapors is modifiable by programming the electronic board.

16. The electromechanically operated fuel nozzle of claim 1, wherein the electromechanical valve device comprises a continuously variable electromechanical vapor control valve.

17. The electromechanically operated fuel nozzle of claim 16, wherein the continuously variable electromechanical vapor control valve is a ball valve.

18. The electromechanically operated fuel nozzle of claim 17, wherein a ball of the continuously variable electromechanical vapor control valve is driven by a motor that drives a pilot valve.

19. The electromechanically operated fuel nozzle of claim 16, wherein the continuously variable electromechanical vapor control valve is controlled proportionally with respect to a pilot valve.

* * * * *